US006151995A

United States Patent [19]

Shu

[11] Patent Number: 6,151,995

[45] Date of Patent: Nov. 28, 2000

[54] RATCHET MECHANISM HOUSING ASSEMBLY FOR A RATCHET SCREWDRIVER

[76] Inventor: Zu-Shung Shu, P.O. Box 63-247, Taichung, Taiwan

[21] Appl. No.: 09/229,237

[22] Filed: Jan. 12, 1999

[51] Int. Cl.[7] ..... B25B 13/46

[52] U.S. Cl. ..... 81/63.1; 81/62; 192/43.1

[58] Field of Search ..... 81/62, 63.1, 60; 194/43.1

[56] References Cited

U.S. PATENT DOCUMENTS 5,379,873 1/1995 Shiao ..... 81/63.1 X
5,910,196 6/1999 Huang ..... 81/63.1 X

*Primary Examiner*—James G. Smith
*Attorney, Agent, or Firm*—Alan Kamrath

[57] ABSTRACT

A ratchet mechanism housing assembly for a ratchet screwdriver includes a main body including a compartment defined by a first lateral wall, a second lateral wall, a first end wall, and a second end wall opposite to the first end wall. A tool receiver has an end extended through the second end wall and received in the compartment of the main body. The end of the tool receiver has a ratchet wheel formed thereon. A first pawl includes two protrusions received in two first recesses in the first end wall. A recessed area is defined between the protrusions for fittingly receiving a protruded wall section between the first recesses of the first end wall. The first pawl further includes a first driving part having a first rectilinear edge that bears against a face of one of the teeth of the ratchet wheel. The first driving part further including a first arcuate engaging edge that is opposite to the first rectilinear edge and that bears against a first recessed wall section on the first lateral wall. A second pawl includes a second recess for receiving a protrusion on the second end wall. The second pawl further includes a third recess for engaging with an arcuate wall section of the first lateral wall. The second pawl further includes a second driving part having a second rectilinear edge that that bears against a face of one of the teeth of the ratchet wheel. The second driving part further includes a second arcuate engaging edge that is opposite to the second rectilinear edge and that bears against a second recessed wall section on the second lateral wall. The face born against by the first driving part and the face born against by the second driving part face away from each other.

1 Claim, 2 Drawing Sheets

RATCHET MECHANISM HOUSING ASSEMBLY FOR A RATCHET SCREWDRIVER

BACKGROUND OF THE INVENTION

1. Field of the Invention

The present invention relates to a ratchet mechanism housing assembly for a ratchet screwdriver with improved strength to allow high torque operation.

2. Description of the Related Art

A wide variety of ratchet screwdrivers have heretofore been provided. For example, U.S. Pat. No. 4,290,328 to Clark issued on Sep. 22, 1981 discloses a ratchet handle including a composite ratchet gear; U.S. Pat. No. 4,621,718 to DeCarolis issued on Nov. 11, 1986 discloses a ratchet screwdriver; U.S. Pat. No. 4,696,208 to Lay issued on Sep. 29, 1987 discloses a direction-changeable structure of hand tool handle; and U.S. Pat. No. 5,379,873 to Shiao issued on Jan. 10, 1995 discloses a ratchet mechanism housing assembly for a ratchet screwdriver.

A common disadvantage of ratchet screwdrivers is that the pawls or members for actuating the ratchet wheel have a relatively small width such that they cannot provide sufficient torque for driving the ratchet wheel. The pawls or the ratchet wheel-actuating members might bend in some cases. In addition, the pawls or the ratchet wheel-actuating members have a relatively small contact area with the ratchet wheel and thus can be used in small torque operation only. The present invention is intended to provide an improved ratchet mechanism housing assembly that mitigates and/or obviates the above-mentioned disadvantage.

SUMMARY OF THE INVENTION

In accordance with the present invention a ratchet mechanism housing assembly is provided for a ratchet screwdriver. The ratchet mechanism housing assembly comprises:

a main body including a compartment defined by a first lateral wall, a second lateral wall, a first end wall, and a second end wall opposite to the first end wall, the first end wall including two first recesses and a protruded wall section between the first recesses, the second end wall including an opening and a first protrusion extended toward the first end wall, the first lateral wall including a first recessed wall section and an arcuate wall section, the second lateral wall including a second recessed wall section, a tool receiver having an end extended through the opening of the second end wall and received in the compartment of the main body, the end of the tool receiver including a ratchet wheel formed thereon, the ratchet wheel including a plurality of teeth each having two faces, a first pawl including two second protrusions respectively received in the first recesses in the first end wall, a recessed area is defined between the second protrusions for fittingly receiving the protruded wall section of the first end wall, the first pawl further including a first driving part having a first rectilinear edge that bears against one of the faces of one of the teeth of the ratchet wheel, the first driving part further including a first arcuate engaging edge that is opposite to the first rectilinear edge and that bears against the first recessed wall section of the first lateral wall, a second pawl including a second recess for receiving the first protrusion on the second end wall, the second pawl further including a third recess for engaging with the arcuate wall section of the first lateral wall, the second pawl further including a second driving part having a second rectilinear edge that bears against one of the faces of one of the teeth of the ratchet wheel, the second driving part further including a second arcuate engaging edge that is opposite to the second rectilinear edge and that bears against the second recessed wall section of the second lateral wall, wherein the face born against by the first driving part and the face born against by the second driving part face away from each other.

By such an arrangement, the first and second pawls are firmly engaged with the main body, and the contact length therebetween is relatively long when compared to the conventional ratchet screwdrivers. Each pawl is supported at three points. As a result, the tool attached to the tool receiver is allowed to proceed with high torque operation in either direction. In addition, the reactive force transmitted from the ratchet wheel as a result of driving a screw or the like may be imparted to the first and second lateral walls of the main body. Thus, the deformations of the first and second pawls are avoided. Thus, the ratchet mechanism housing assembly in accordance with the present invention has improved strength to allow high torque operation in either direction.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
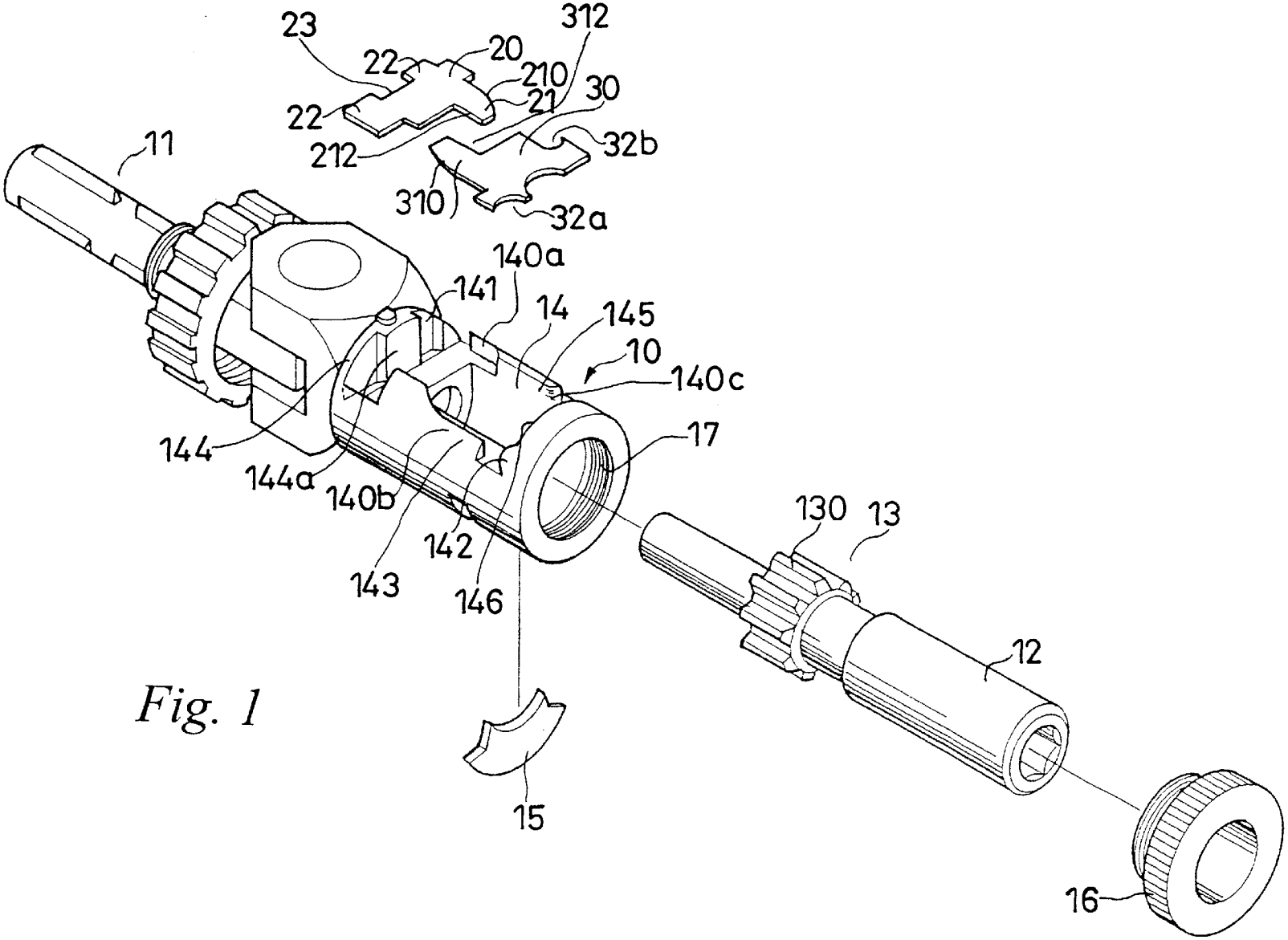
FIG. 1 is an exploded perspective view of a ratchet screwdriver with a ratchet mechanism housing assembly in accordance with the present invention.
Figure 2:
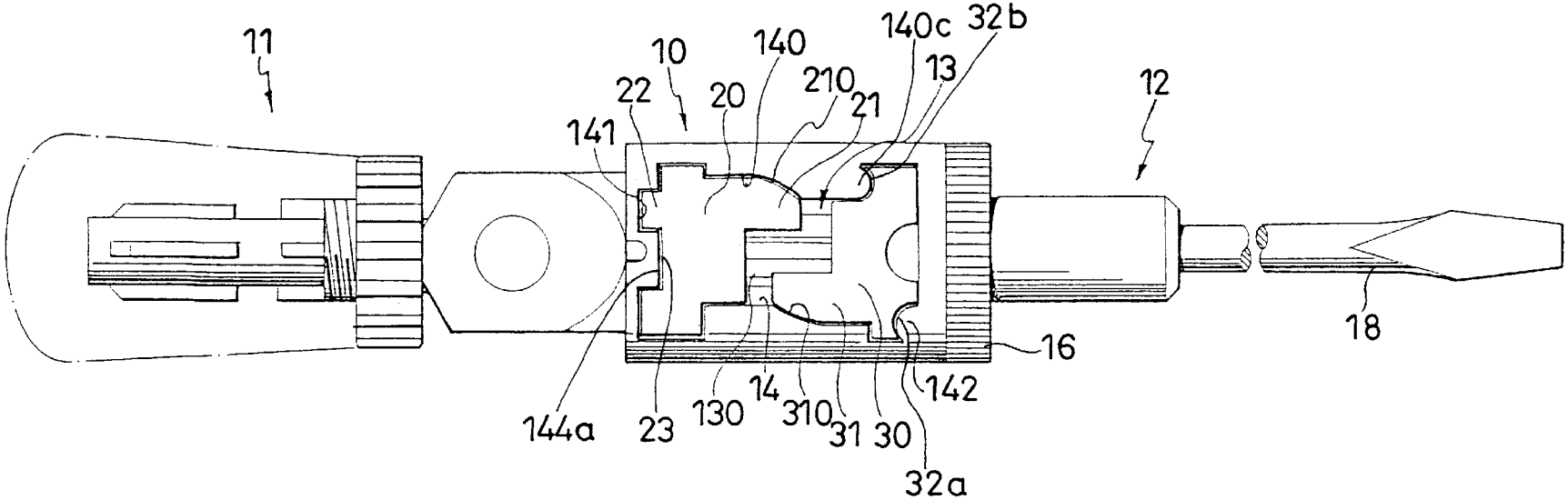
FIG. 2 is a top view of the ratchet screwdriver in accordance with the present invention.

Referring to FIGS. 1 and 2, a ratchet screwdriver in accordance with the present invention generally includes a ratchet mechanism housing assembly for receiving a tool receiver 12. The housing assembly comprises a main body 10 including a compartment 14 defined by two lateral walls 143 and 145 and two end walls 144 and 146. Each lateral wall 145, 143 includes a recessed wall section 140*a*, 140*b*, which will be described later. The end wall 144 includes two recesses 141 and a protruded wall section 144*a* between the recesses 141, while the end wall 146 includes a protrusion 142. A handle 11 is attached to the end wall 144. The end wall 146 further includes an opening 17 through which the tool receiver 12 is extended. A tool 18 (FIG. 2) is removably received in a front end of the tool receiver 12 and retained in place by a sleeve 16, which is conventional and therefore not further described. A ratchet wheel 13 is formed on a rear end of the tool receiver 12 and includes a number of ratchet teeth 130. A key plate 15 abuts one side of the ratchet wheel 13 to prevent axial movement of the tool receiver 12 relative to the main body 10.

The ratchet mechanism housing assembly in accordance with the present invention further includes two pawls 20, 30. The pawl 20 includes two protrusions 22 respectively received in the recesses 141 of the end wall 144 to retain the pawl 20 in place. A recessed area 23 is defined between the protrusions 22 for fittingly receiving the protruded wall section 144*a* of the end wall 144. In addition, the pawl 20 includes a driving part 21 having a rectilinear edge 212 that bears against one of two faces of one of the teeth 130 of the ratchet wheel 13. The driving part 21 further includes an arcuate engaging edge 210 that is opposite to the rectilinear edge 212 and that bears against the recessed wall section 140*a* of the lateral wall 145. Similarly, the pawl 30 includes a first recess 32*a* that engages with the protrusion 142 on the end wall 146 and a second recess 32b that engages with an arcuate wall section 140*c* of the lateral wall 145. The pawl 30 further includes a driving part 31 having a rectilinear edge 312 that bears against one of two faces of one of the teeth of the ratchet wheel 13. The face born against by the driving part 31 and the face born against by the driving part 21 face away from each other. The driving part 31 further includes an arcuate engaging edge 310 that is opposite to the rectilinear edge 312 and that bears against the recessed wall section 140*b* of the lateral wall 143.

As can be seen from FIG. 2, the pawls 20 and 30 are firmly engaged with the main body 10, and the contact length therebetween is relatively long when compared to the conventional ratchet screwdrivers. Each pawl 20, 30 is supported at three points. As a result, the tool 18 (FIG. 2) is allowed to proceed with high torque operation in either direction. In addition, the reactive force transmitted from the ratchet wheel as a result of driving, e.g., a screw (not shown) may be imparted to the lateral walls 143 and 145 of the main body 10. Thus, the deformations of the pawls 20 and 30 are avoided. Thus, the ratchet mechanism housing assembly in accordance with the present invention has improved strength to allow high torque operation in either direction.

Although the invention has been explained in relation to its preferred embodiment, it is to be understood that many other possible modifications and variations can be made without departing from the spirit and scope of the invention as hereinafter claimed.

What is claimed is:

1. A ratchet mechanism housing assembly for a ratchet screwdriver, comprising:

a main body including a compartment defined by a first lateral wall, a second lateral wall, a first end wall, and a second end wall opposite to the first end wall, the first end wall including two first recesses and a protruded wall section between the first recesses, the second end wall including an opening and a first protrusion extended toward the first end wall, the first lateral wall including a first recessed wall section and an arcuate wall section, the second lateral wall including a second recessed wall section, a tool receiver having an end extended through the opening of the second end wall and received in the compartment of the main body, the end of the tool receiver including a ratchet wheel formed thereon, the ratchet wheel including a plurality of teeth each having two faces, a first pawl including two second protrusions respectively received in the first recesses in the first end wall, a recessed area is defined between the second protrusions for fittingly receiving the protruded wall section of the first end wall, the first pawl further including a first driving part having a first rectilinear edge that bears against one of the faces of one of the teeth of the ratchet wheel, the first driving part further including a first arcuate engaging edge that is opposite to the first rectilinear edge and that bears against the first recessed wall section of the first lateral wall, a second pawl including a second recess for receiving the first protrusion on the second end wall, the second pawl further including a third recess for engaging with the arcuate wall section of the first lateral wall, the second pawl further including a second driving part having a second rectilinear edge that bears against one of the faces of one of the teeth of the ratchet wheel, the second driving part further including a second arcuate engaging edge that is opposite to the second rectilinear edge and that bears against the second recessed wall section of the second lateral wall, wherein the face born against by the first driving part and the face born against by the second driving part face away from each other.

* * * * *